US005112341A

United States Patent [19]

Doley

[11] Patent Number: 5,112,341

[45] Date of Patent: May 12, 1992

[54] HAIR REMOVAL DEVICE WITH CENTRAL MULTIPLE-TWEEZER ELEMENT

[76] Inventor: Moshe Doley, 22 Yehiam St., Ramat Hasharon, Israel

[21] Appl. No.: 664,768

[22] Filed: Mar. 5, 1991

[51] Int. Cl.[5] ..... A61B 17/00

[52] U.S. Cl. ..... 606/133; 606/131

[58] Field of Search ..... 606/36, 43, 131, 133

[56] References Cited

U.S. PATENT DOCUMENTS

| | | | |
|---|---|---|---|
| 4,079,741 | 3/1978 | Daar et al. | 606/133 |
| 5,032,126 | 7/1991 | Cleyet et al. | 606/133 |
| 5,041,123 | 8/1991 | Oliveau et al. | 606/133 |

*Primary Examiner*—Stephen C. Pellegrino
*Assistant Examiner*—Glenn K. Dawson
*Attorney, Agent, or Firm*—Edward Langer

[57] ABSTRACT

A hair removal device having a multiple-tweezer element arranged to pluck skin hair, by plucking action of a set of movable tweezers in a continuously repetitive fashion. In the preferred embodiment, the hair removal device is provided as a hand-held, motor-powered design having a hair plucking element which comprises a set of disc-shaped, fixed-position tweezer elements and an interleaved set of disc-shaped, movable tweezer elements mounted on a central shaft. The spaces formed between these elements are repetitively opened and closed by lateral push-pull sliding motion of the shaft against a cam which drives the movable elements in both directions in relation to the fixed-position elements, to trap and pluck skin hair. The design allows for an increase in the effective number of hair plucking operations over prior art designs since the spaces may be closed at any time, thus improving the mechanical efficiency without additional mechanical parts. In an alternative embodiment, an external support cylinder supports the edges of the movable elements, concentrating the plucking force developed, and reducing the central shaft movement by approximately half, thus enabling a further increase in the number of hair plucking operations. In another alternative embodiment, the fixed-position tweezer elements are provided in a cloverleaf-shaped drum formed with slits within which the movable elements are disposed.

14 Claims, 3 Drawing Sheets

HAIR REMOVAL DEVICE WITH CENTRAL MULTIPLE-TWEEZER ELEMENT

FIELD OF THE INVENTION

The present invention relates to motorized depilatory devices for removing unwanted skin hair, and more particularly, to a new and useful hair removal device having a multiple-tweezer element operable via a slidable central shaft to pluck skin hair.

BACKGROUND OF THE INVENTION

The prior art of motor-powered depilatory devices using springs for removing skin hair is based on a well-known operational concept of an early mechanical device disclosed in Swiss Pat. 268,696 to Fischer. This hand-operated device uses an arched coil spring to trap and pluck hair between its loops as it rolls over the skin.

Other hand-operated coil spring designs are disclosed in the group including Swiss Patent 179,261 to Macioce, U.S. Pat. No. 2,458,911 to Kerr, U.S. Pat. No. 2,486,616 to Schubiger, British Patent 203,970 to Davis, U.S. Pat. No. 1,743,590 to Binz, and U.S. Pat. No. 1,232,617 to Shipp. There vary in the mechanical arrangements for stretching the spring and engaging the hair between coil spring loops before it is trapped upon closure of the stretched spring.

U.S. Pat. No. 4,079,741 to Daar et al. discloses a single tension spring disposed parallel to the skin and arranged to be stretched and compressed so as to pluck hairs trapped between its loops. The overall design is complicated and expensive.

An arched helical spring provided with high speed rotational motion for opening and closing the loops is provided in U.S. Pat. No. 4,524,772 to Daar et al. U.S. Pat. Nos. 4,726,375 and 4,807,624 to Gross et al. disclose a rubber hair-plucking element with partially circumferential slits or rubber discs for trapping and plucking skin hair.

These patents are all based on the concept of rotating the coil spring or slits near the skin to enable hairs to become trapped, but they have a tendency to "wind" while slowly developing sufficient hair-pulling tension, and this creates additional discomfort in use of these devices. In addition, with the spring designs, the contact with the hair is point-like, increasing the likelihood that hair will be pinched and torn, but not plucked.

U.S. Pat. No. 1,923,415 to Bingham discloses a plurality of rotatable discs arranged to be bent one or more times toward each other at a point during each revolution, causing them to pluck bird feathers. This design is not applicable to hair plucking as it is complicated, expensive to manufacture, and inefficient.

French Patent 1,017,490 to Bachofen discloses a bird feather plucking device using a set of rotatable discs, each disc having a curved surface area, and being arranged to be bent toward one another at a point during each revolution. Again, this is a complicated, and inefficient design.

Another device for removing bird feathers is disclosed in French Patent 1,123,971 to Jadoul, based on a plurality of rotatable discs arranged to be bent toward one another at a point during each revolution. Again, this is an inefficient design.

Still another poultry feather plucking device is disclosed in U.S. Pat. No. 2,496,223 to Lanzisera, based on the use of a helical spring which rotates on one side of a grid, such that feathers which project through the grid are grasped between loops of the spring and are plucked. This design allows only one plucking action per revolution of the spring, besides being complicated and expensive to manufacture.

In general, the spring and disc designs available for feather plucking are not applicable to hair plucking, due to their size, complicated construction and inefficient operation.

Another disc design is disclosed in U.S. Pat. No. 2,900,661 to Schnell, wherein a pair of discs rotate at a large angle to each other and converge at a contact point whereat hairs are plucked. The large size of this design makes it inefficient since only a few discs can be located within a given space, and the inflexible discs tend to cut the hair, not pluck it.

In U.S. Pat. No. 4,575,902 to Alazet, there is disclosed a depilatory device comprising a series of adjacent, closely-spaced hair-plucking discs driven by an electric motor. In one embodiment, the discs are periodically deformed during rotation so as to trap hair between them as they are pressed together. This design very similar to the Jadoul patent described earlier, and is similarly inefficient since the discs close only once per rotation, limiting plucking action to a short time interval. Also, it is not feasible to achieve closure of the large number of discs by deformation since the cumulative spacing is too great.

In the second embodiment disclosed in the Alazet patent, a pair of movable hair-gripping combs are positioned between adjacent discs to provide hair plucking when they are applied against the discs. Each of the combs is movable on its own shaft and its area covers only an angular sector of the disc against which it is applied, so that only a partial disc area is effective for plucking of hair. The disclosure suggests that more than two combs may be used to increase the effective disc area used for plucking, but this would require additional movable shafts and cams, which cannot be achieved within a limited space without further complicating the construction and operation.

A design similar to Alazet is marketed by Calor under the tradename "Caresse" and uses two cam-operated shafts for moving a set of movable tweezers against a set of fixed discs in one direction only, once per revolution. Another similar design is marketed by Braun under the tradename "Silkappeal" and has a plurality of moving segments closing against one another once per revolution. Both are complicated and inefficient designs.

In my previous U.S. Pat. No. 4,935,024 there is disclosed a novel coupled-disc element which reduces the "winding" phenomenon of previous designs, while reducing the painful sensation.

It would therefore be desirable to provide a power-driven depilatory device which provides efficient hair removal by increasing the number of hair plucking operations using a simplified construction.

It would also be desirable to provide a depilatory device which is simple in construction for cost-effective production, while durable in use.

Additionally, it would be desirable to provide a depilatory device which minimizes pain in relation to prior art spring designs and achieves greater efficiency with respect to prior art discs designs, while being simple to manufacture, use and maintain.

SUMMARY OF THE INVENTION

Accordingly, it is a principal object of the invention to provide a hair removal device having a multiple-tweezer element arranged to pluck skin hair, by plucking action of a set of movable tweezers in a continuously repetitive fashion.

In accordance with a preferred embodiment of the present invention, there is provided a multiple-tweezer depilatory device, said device comprising:

a housing;

a motor disposed within said housing;

multiple-tweezer hair plucking means comprising a set of interleaved fixed-position and movable planar elements defining spaces therebetween and being arranged for rotation with a central shaft which is slidable therethrough laterally in either direction and powered for rotation by said motor, said movable elements being movable laterally with said shaft between said fixed-position elements; and motion control means arranged to force repetitive, lateral push-pull sliding motion of said shaft, such that when said rotating hair plucking means is placed near the skin, sliding motion of said shaft therewithin causes said spaces to alternately open and tightly close, trapping skin hair in said spaces when opened and plucking it when closed.

In the preferred embodiment, the hair removal device is provided as a hand-held, motor-powered design having a hair plucking element which comprises a set of disc-shaped, fixed-position tweezer elements and an interleaved set of disc-shaped, movable tweezer elements. A set of spaces formed between these two sets of elements is repetitively opened and closed by lateral movement of the movable elements on a central shaft in relation to the fixed-position elements, to trap and pluck skin hair.

The movable elements are driven in both directions within the spaces formed between them and the fixed-position elements. Thus, either face of an individual movable element may contact an opposing face of adjacent fixed-position elements.

The mechanical design includes a rotating cam for controlling lateral motion of the movable elements with respect to the fixed-position elements during their rotation. Since these two groups of elements are always opposite each other, appropriate design of the cam enables the spaces between them to be closed at any time by lateral movement of the central shaft in either direction. As a result, the effective number of hair plucking operations during a single revolution of the elements may be increased over the prior art designs, thus improving the overall mechanical efficiency with fewer mechanical parts.

As compared with other prior art depilatory devices based on a disc design, the slidable central shaft of the inventive design simplifies the mechanical design and operation.

In an alternative embodiment, the edges of the movable elements are supported externally on the side nearest an external support cylinder so as to concentrate the plucking force developed on the far side of these edges against the fixed-position element edges, to insure effective grasping and plucking of hair.

In addition, by fixing the position of the movable element edges on one side, the external support cylinder enables a reduction in central shaft movement by approximately half, enabling a further increase the number of hair plucking operations by appropriate cam design.

In still another alternative embodiment, the fixed-position tweezer elements are provided by a cloverleaf-shaped drum formed with slits within which the movable tweezer elements are disposed.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
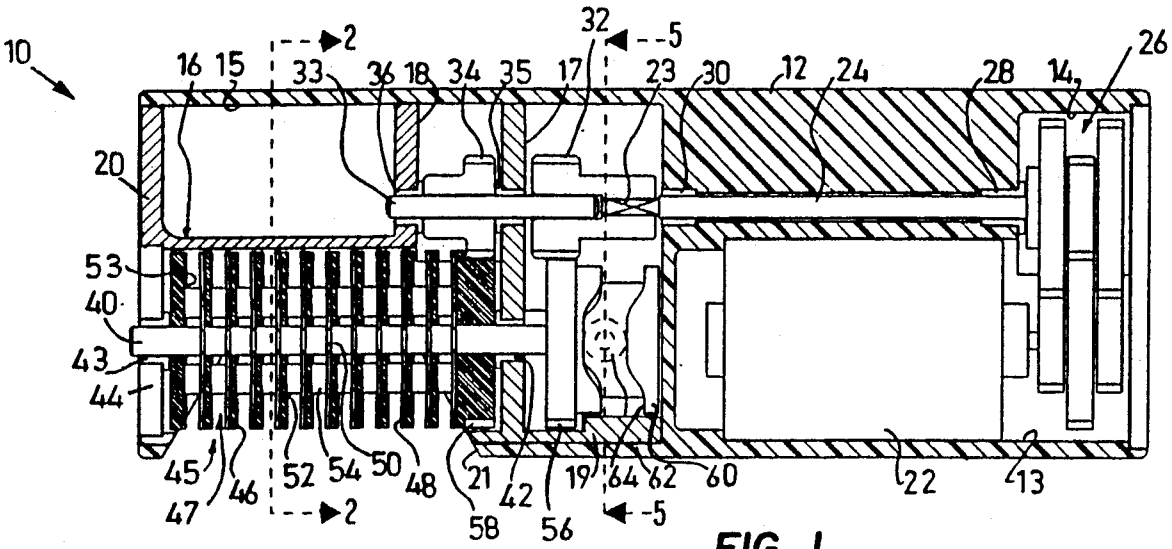
FIG. 1 is a longitudinal cross-section of a multiple tweezer hair removal device constructed and operated in accordance with the present invention.

Referring now to FIG. 1, there is shown a longitudinal cross-section of a multiple tweezer hair removal device 10 constructed and operated in accordance with the principles of the present invention. Device 10 comprises a housing 12 having a motor compartment 13, a gear compartment 14, and a tweezer assembly compartment 15 comprising a cage 16 defined by interior walls 17–19, and end wall 20. Tweezer assembly compartment 15 is open along an exterior wall 21. Motor compartment 13 contains a miniature electric motor 22, which is arranged to provide rotational power to a drive shaft 24, via a set of reduction gears 26.

Drive shaft 24 is rotatably supported on bearings 28 and 30 mounted within housing 12, and provides rotational power to gear 32 via a rotational coupling 23 which is integrally formed with drive shaft 24. Rotational power is transferred to gear 34, via shaft 33, which is supported by bearings 35–36. Bearings 35–36 are seated, respectively, in interior walls 17–18. Interior wall 19 defines the lower portion of cage 16 in tweezer assembly compartment 15.

A second shaft 40 is rotatably supported by bearings 42–43 which are seated, respectively, in interior wall 17 and in end support 44 mounted in end wall 20 of cage 16. Shaft 40 is also slidable laterally within bearings 42–43. In addition, shaft 40 provides rotational support for a hair-plucking tweezer assembly 45, which comprises a set of disc-shaped, fixed-position elements 46 and an interleaved set of disc-shaped movable elements 48, centrally mounted on shaft 40, and forming spaces 47 therebetween. Each of the movable elements 48 has formed therein a keyhole slot 49 the edges of which are seated in a groove 50 formed circumferentially at spaced apart intervals along shaft 40. In addition to slot 49, the movable elements 48 have holes 52–53 formed therein.

Each of fixed-position elements 46 is formed with three round, stepped protrusions 54 and depressions 55. Protrusions 54 are designed to pass through slot 49 and holes 52–53, and fit within depressions 55 on adjacent fixed-position elements 46, providing a snap-fit arrangement. Thus, tweezer assembly 45 is constructed as a unit in which fixed-position and movable elements 46–48 rotate together with shaft 40 rotation.

The design of cage 16 allows it to be easily inserted or removed as a unit from housing 12, simplifying initial construction of device 10, and when necessary, allowing removal and replacement of tweezer assembly 45 for purposes of cleaning and maintenance. It will be appreciated that the design of tweezer assembly 45 also permits it to be supported for rotation by cage 16 instead of shaft 40.

Shaft 40 and assembly 45 are driven for rotation, respectively, by gears 56 and 58, which are mounted, respectively, in tight-fit and slide-fit fashion on shaft 40. Gears 56 and 58 are respectively driven by gears 32 and 34, via rotational driving motion of shafts 24 and 33. The gear ratios of gears 32, 56 and 34, 58 are the same, and as a result, no torsional force is developed between shaft 40 and tweezer assembly 45, allowing shaft 40 to freely slide laterally therein with minimum friction.

Figure 5:
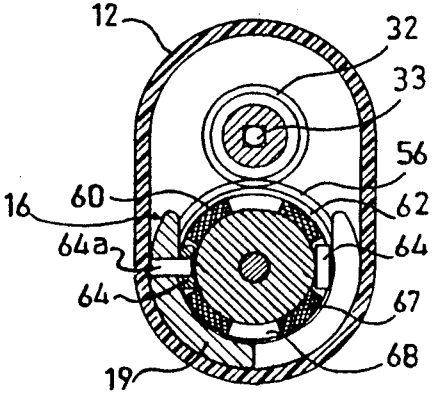
FIG. 5 is a cross-sectional view of the cam arrangement of FIG. 1, taken along section lines V—V.

Integrally formed with one side of gear 56 is a cam 60, which is also mounted in tight-fit fashion on shaft 40, and has a circumferential groove 62 formed therein. A cam follower 64 is rotatably supported on pin **64*a*, which extends from interior wall 19 of cage 16 (FIG. 5). Cam follower 64 engages groove 62 such that as gear 32 drives rotation of cam 60 via gear 56, the contour of groove 62 shifts the position of cam 60 against cam follower 64 and causes shaft 40 to slide laterally, forcing movable elements 48 of tweezer assembly 45 to move laterally therewith in spaces 47**.

Figure 2:
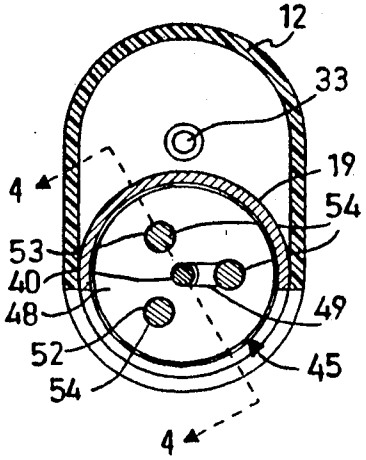
FIG. 2 is a cross-sectional view of the hair removal device of FIG. 1, taken along section lines II—II.
Figure 4:
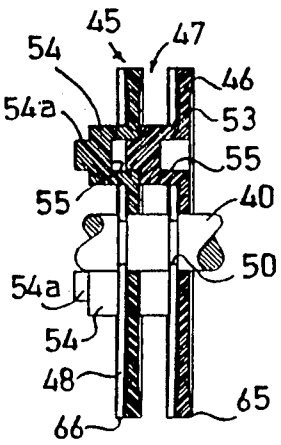
FIG. 4 is a cross-sectional view of the tweezer arrangement of FIG. 2, taken along section lines IV—IV.

In FIG. 2, a cross-sectional view of hair removal device 10 is shown, taken along section lines II—II of FIG. 1. A movable element 48 is shown formed with slot 49 and holes 52–53. Also visible are protrusions 54, which pass through slot 49 and holes 52–53 and interlock with depressions 55 in adjacent fixed-position elements 46, as shown in the cross-sectional view of FIG. 4, taken along section lines IV—IV of FIG. 2. The enlarged scale of FIG. 4 also reveals further construction details of the fixed-position elements 46, including the flared outer edges 65 which serve to insure tight contact against the outer edges 66 of movable elements 48.

Figure 3:
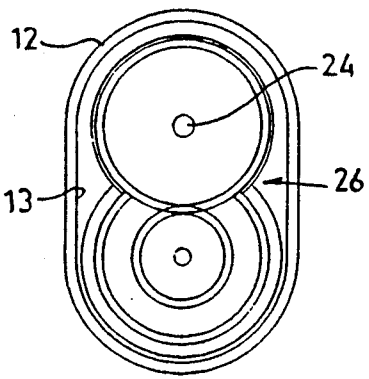
FIG. 3 is an end view of a gear compartment provided in the hair removal device.

FIG. 3 shows an end view of the arrangement of reduction gears 26 which transfer rotational motion from motor 22 to shaft 24. FIG. 5 is a cross-sectional view taken along section lines V—V of FIG. 1. The construction of cam 60 is visible, with the inclined portions 67 of groove 62 shown as shaded areas, and the flat portions 68 shown as blank areas. Also visible are cam follower 64 and pin **64*a* extending from interior wall 19, which is designed with rigidity to support lateral motion of shaft 40**.

In operation, when motor 22 is powered by batteries or supplied with power by a conventional cord and plug connection (not shown), drive shaft 24 is supplied with rotational power via reduction gears 26. Rotational power is transferred via drive shaft 24 to cam 60 via gear 32 and gear 56. Gear 34 drives rotation of tweezer assembly 45 via gear 58. During rotation of cam 60, the engagement of cam follower 64 in groove 62 causes lateral movement of cam 60 and gear 56 in accordance with the groove 62 shape.

Thus, cam 60 forces shaft 40 to move laterally, due to push-pull sliding motion. Gears 32 and 56 remain enmeshed since their widths are designed so that lateral movement of shaft 40 does not affect their operation. The lateral movement of shaft 40 causes each of movable elements 48 to move between an opposing pair of fixed-position elements 46. By appropriate design of groove 62 is cam 60, the degree of lateral movement to which shaft 40 is subjected dictates that edges 66 of movable elements 48 are pressed tightly against edges 65 of opposing fixed-position elements 46.

In accordance with the principles of the present invention, lateral movement of shaft 40 is designed to be slightly more than is necessary to bring edges 66 into contact with edges 65. This allows greater latitude in manufacturing tolerances, and allows for larger amounts of mechanical wear, which increases service life. Additional shaft 40 motion, beyond that required for making contact, produces slight arching of movable elements 48 against edges 65 of fixed-position elements 46, insuring greater efficiency in grasping and plucking or hairs.

When passed over the skin, tweezer assembly 45 operates such that lateral motion of movable elements 48 causes alternate opening and closing of spaces 47 between them and fixed-position elements 46. Therfore, individual hairs in a given skin area are trapped within the open spaces 47 between elements 46 and 48. As lateral movement of shaft 40 continues and spaces 47 close, these hairs are trapped, and they are plucked during continued tweezer assembly 45 rotation. During lateral movement of shaft 40 in the reverse direction, these plucked hairs are released as spaces 47 re-open.

The push-pull lateral movement of shaft 40 determines the number of plucking operations that will occur in a given revolution of tweezer assembly 45. With the appropriate design of cam 60 and groove 62, the number of plucking operations may be increased significantly over that of prior art designs. Since the movable elements 48 are opposite the fixed-position elements 46 continuously, they are capable of as many plucking operations as desired in accordance with the cam 60 design. The use of shaft 40 in the push-pull mode to control these plucking operations reduces the number of mechanical parts required to achieve the increased number of repetitive plucking opertions.

Figure 6:
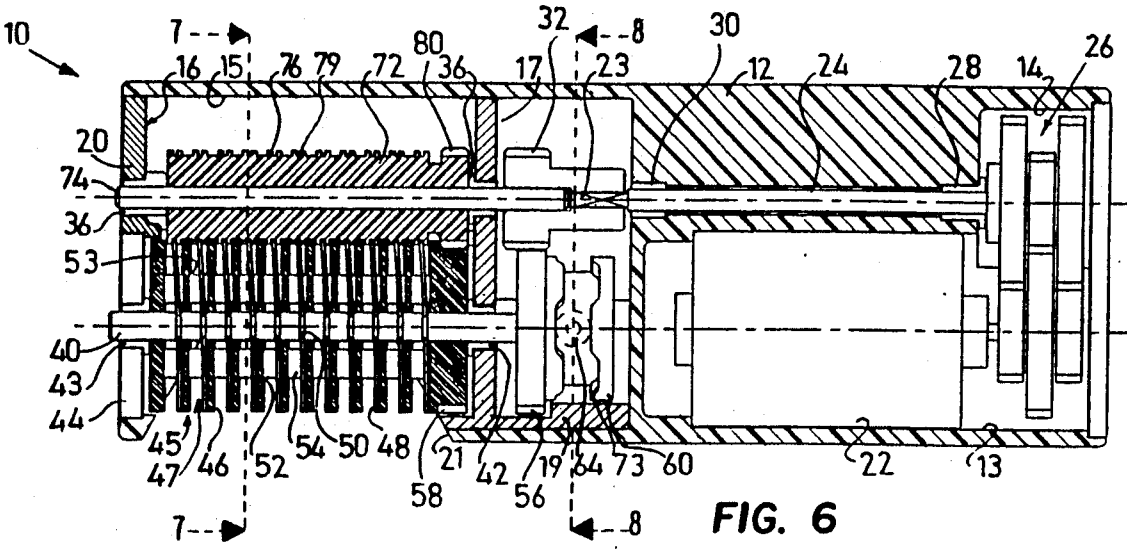
FIG. 6 is a longitudinal cross-section of an alternative embodiment of a hair removal device, featuring an external support cylinder for support of the tweezer arrangement.

In FIG. 6, there is shown a longitudinal cross-section of an alternative embodiment of hair removal device 10. This embodiment features an external support cylinder 72 for support of movable elements 48 of tweezer assembly 45, to reduce the lateral movement of shaft 40 by approximately half. External support cylinder 72 is rotatably supported on a shaft 74 by a set of bearings 36, which are seated in end wall 20 and in an interior wall 17 defining cage 16. In this embodiment, reduction of lateral shaft 40 movement enables cam 60 to be redesigned with a groove 73, which provides an increase in the number of plucking operations, as further described herein.

In accordance with the principles of the present invention, external support cylinder 72 is designed to assist the operation of tweezer assembly 45 in achieving increased efficiency by povidng more hair plucking operations per revolution, while enabling it to tightly grip and successfully pluck individual hairs. For this purpose, external support cylinder 72 is constructed with a set of rings 76 extending circumferentially thereabout along its length. Rings 76 are grouped in pairs, forming gaps 79 therebetween. At one end of external support cylinder 72 there is mounted a gear 80, which is enmeshed with gear 58 mounted at the end of tweezer assembly 45.

In this embodiment, the tweezer assembly 45 construction remains the same as shown in FIG. 1. The outer circumferential edges 66 of movable elements 48 which are located nearest external support cylinder 72 are supported in gaps 79 formed between rings 76. The outer circumferential edges 66 of elements 48 which are furthest from external support cylinder 72 are in contact with the outer edges 65 of fixed-position elements 46. By virtue of the support provided to the near side edges 66, the plucking force developed on the far side of edges 66 is concentrated at one point of contact with fixed-position element 46, to insure effective plucking of hair.

Figure 7:
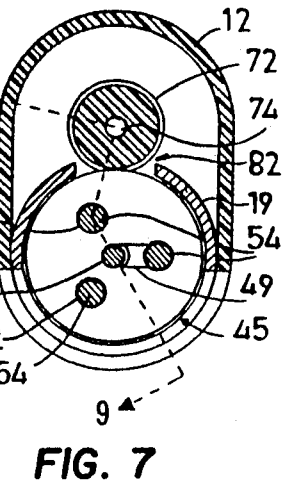
FIGS. 7–8 are, respectively, cross-sectional views of the hair removal device of FIG. 6, taken along section lines VII—VII and VIII—VIII.

FIG. 7 shows a cross-sectional view of the embodiment of FIG. 6 taken along section lines VII—VII, revealing a longitudinal opening 82 in cage 16 to allow contact between support cylinder 72 and movable elements 48 of assembly 45.

Figure 9:
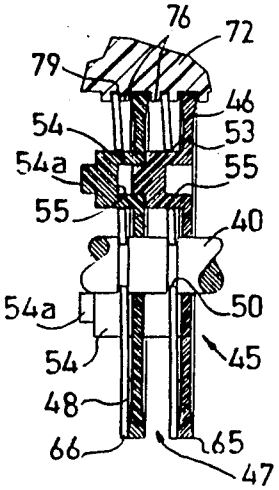
FIG. 9 is a cross-sectional view of FIG. 7 taken along section lines IX—IX.
Figure 8:
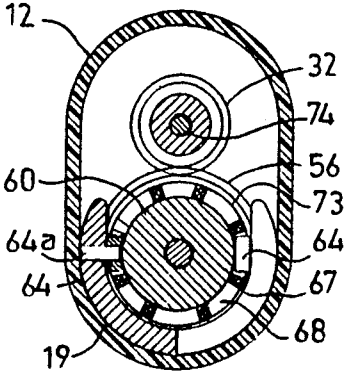

FIG. 8 is a cross-sectional view of the embodiment of FIG. 6, taken along section lines VIII—VIII, and revealing the construction of cam 60. In this embodiment, groove 73 of cam 60 has an increases number of flat and inclined portions 67–68 over that provided by groove 62 (FIG. 5). In the cross-sectional view of FIG. 9, taken along section lines IX—IX of FIG. 7, an enlarged scale of the engagement between external support cylinder 72 and tweezer assembly 45 is shown. The outer circumferential edges 66 of movable elements 48 nearest external support cylinder 72 are supported in gaps 79, so that their position is fixed as shaft 40 slides laterally. Due to the engagement of gears 58 and 80, elements 48 and external support cylinder 72 rotate in opposite directions, and since their tangetial speed is almost equal, minimum friction is developed between them.

In operation, when motor 22 supplies drive shaft 24 and 74 with rotational power, external support cylinder 72 and tweezer assembly 45 are driven to rotate by gears 80 and 58. During rotation of cam 60, the engagement of cam follower 64 in groove 73 causes cam 60 to move laterally in accordance with the groove 73 shape. As before, shaft 40 moves laterally by push-pull sliding motion, causing movable elements 48 to move between an opposing pair of fixed-position elements 46, so that its outer circumferential edges 66 furthest from external support drum 72 contact the facing outer edges 65 of elements 46.

While the far side outer edges 66 of movable elements 48 "flip" from side-to-side between fixed-position elements 46, the near side outer edges 66 of movable elements 48 remain in their respective positions within gaps 79, which act as a "hinge" by virtue of the external support cylinder 72 design. The movement of the far side outer edges 66 is thus twice as much as the lateral movement of shaft 40, and by appropriate design of groove 73 in cam 60, a greater number of hair plucking operations may be achieved per revolution by more frequent push-pull motion.

While near side outer edges 66 of movable elements 48 are supported in gaps 79, for side outer edges 66 of these elements come into tight contact with the opposing edges 65 of fixed-position elements 46. Thus, when movable elements 48 are subjected to a slightly excessive push-pull movement of shaft 40, these elements become slightly arched, increasing the tweezer assembly 45 hair plucking efficiency by insuring tight contact.

Figure 10:
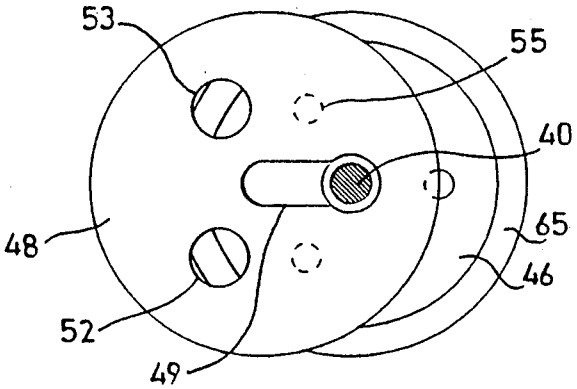
FIG. 10 shows a tweezer arrangement during assembly.

In FIG. 10, an assembly view of tweezer assembly 45 is shown, revealing the placement of slot 49 as each of movable elements 48 is slipped over shaft 40 and then pushed into position opposite fixed-position element 46. Once in position, slot 49 is slid into groove 50 formed on shaft 40, and the next fixed-position element 46 is placed on shaft 40 such that its protrusions 54 pass through slot 49 and holes 52–53, securing movable element 48 in position while enabling protrusion 54*a* to interlock with a depression 55 on the fixed-position element 46 underneath movable element 48. This design simplifies the manufacture and construction of tweezer assembly 45.

Figures 11, 12, 13, 14, 15, 16, 17:
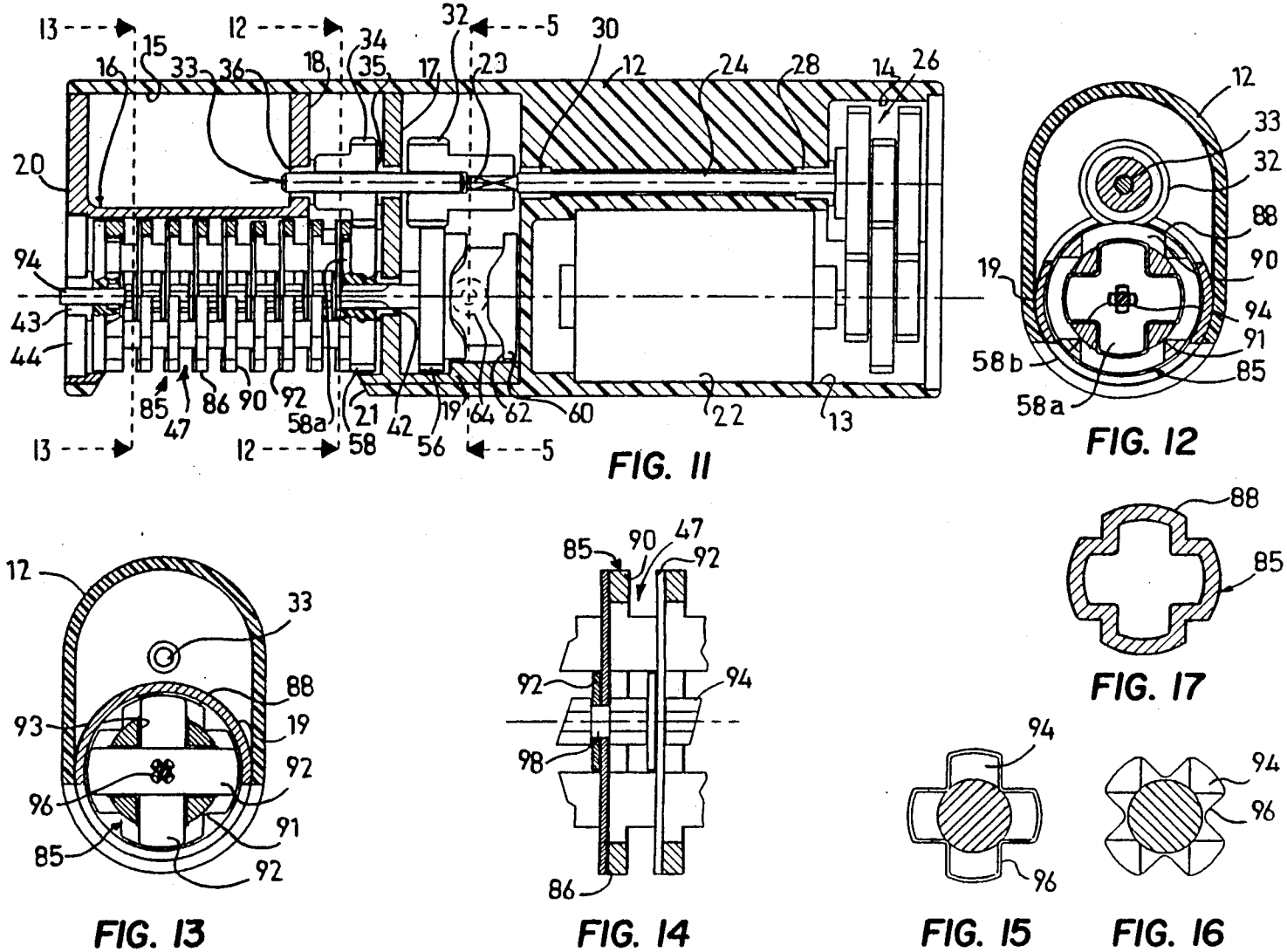
FIG. 11 is a longitudinal cross-section of an alternative embodiment of a hair removal device, featuring a slitted drum comprising the tweezer arrangement.
FIGS. 12 and 13 are, respectively, cross-sectional views of the hair removal device of FIG. 11, taken along section lines XII—XII and XIII—XIII.
FIG. 14 is a detailed view of a portion of the structure of the FIG. 11 embodiment of the hair removal device.
FIGS. 15–16 are enlarged views of portions of FIG. 13.
FIG. 17 is a profile of the slitted drum structure.

Turning now to FIG. 11, there is shown a longitudinal cross-section of an alternative embodiment of hair removal device 10, wherein tweezer assembly 45 is replaced by an alternative construction featuring a slitted drum structure comprising the tweezer assembly 85. FIG. 11 is shown in partial cross-section, revealing the upper half of tweezer assembly 85. The construction of the remaining portions of hair removal device 10 is similar to that of FIG. 1.

Tweezer assembly 85 is constructed as a hallow drum 86, having a profile in the shape of a cloverleaf as shown in the cross-sections of FIGS. 12–13, taken along section lines XII—XII and XIII—XIII, respectively, and the cross-section of FIG. 17. Slitted drum 86 may be manufactured from a hollow, machined, extruded aluminum profile, or by plastic injection molding. In the description which follows, it is to be understood that other suitable profiles may be substituted for the cloverleaf profile.

Drum 86 is formed with slits spaced longitudinally along the length of each of its four ridges 88. Each slit defines a pair of opposite edges 90 which replace the fixed-position elements 46 of the embodiments of FIGS. 1 and 6. Since edges 90 are integrally formed in drum 86, they are interconnected by the indented wall 91 forming a portion of the profile of drum 86.

The disc-shaped movable elements 48 of the previous embodiments are replaced by planar movable elements 92 arranged in crossed fashion (FIGS. 12–13) between interior walls 93 of ridges 88. In this embodiment, spaces 47 are defined between edges 90 and elements 92. FIG. 16 shows an enlarged view of central hole 96 in planar elements 92.

As shown in the cross-section of FIG. 15, central shaft 94 of tweezer assembly 85 has a cloverleaf, matching the shape of the central hole 96 in each of movable elements 92. Tweezer assembly 85 is constructed by arranging pairs of movable elements 92 in crossed fashion so that their edges extend between opposite edges 90 within the slits in drum 86, with their centers 96 aligned. Then, shaft 94 is passed through the centers 96 until they are each aligned with one of grooves 98 formed on shaft 94, as shown in the enlarged detail view of FIG. 15. As in the two previous embodiments, gear 56 and cam 60 are also mounted on shaft 94, which replaces shaft 40.

Once the movable elements 92 are all positioned on shaft 94, the shaft is rotated forty-five degrees to lock all of the elements 92 in grooves 98. When viewed through central hole 96 of an element 92, the edges of shaft 94 are partially blocked from view, since element 92 is locked in groove 98 (FIG. 16).

Upon completion of assembly 85, the cloverleaf-shaped profile of its hollow interior (FIG. 17) is oriented to engage a cloverleaf-shaped protrusion 58*a* which is integrally formed with gear 58. Protrusion 58*a* has a hole 58*b* formed therein shaped to receive shaft 94, fixing its orientation with respect to elements 92 and insuring its rotation together with assembly 85.

As with the embodiment of FIG. 1, when motor 22 supplies drive shaft 24 and 33 with rotational power, the rotational driving motion is transferred via gears 32 and 34 such that slitted drum 86 comprising tweezer assembly 85 rotates. During rotation of cam 60 with shaft 94, the engagement of cam follower 64 in groove 62 causes lateral movement of cam 60 in accordance with the groove 62 shape.

As before, cam 60 forces shaft 94 to move laterally by push-pull sliding motion, causing movable elements 92 to move between a pair of opposite edges 90, and closing and opening the spaces 47 therebetween. Edges 90 are preferably sloped to allow arching of elements 92, while providing tight contact as in previous embodiments. Once assembly 85 rotates, device 10 is passed over the skin for the hair plucking operation. Appropriate design of cam 60 insures that as tweezer assembly 85 rotates, spaces 47 begin to close in the time interval during which movable elements 92 are opposite the skin, the grasp skin hair.

In summary, by virtue of tis novel mechanical design, the inventive hair removal device offers many advantages over prior art depilatory devices based on a disc design. These advantages include simplified operation by use of the slidable central shaft, and increased efficiency in the number of plucking operations per revolution, with fewer mechanical parts.

Having described the invention with regard to certain specific embodiments thereof, it is to be understood that the description is not meant as a limitation since further modifications may now suggest themselves to those skilled in the art, and it is intended to cover such modifications as fall within the appended claims.

I claim:

1. A multiple-tweezer depilatory device, said device comprising:

a housing;

a motor disposed within said housing;

multiple-tweezer hair plucking means comprising a set of interleaved fixed-position and movable planar elements defining spaces therebetween and being arranged for rotation with a central shaft which is slidable therethrough laterally in either direction and powered for rotation by said motor, said movable elements being movable laterally with said shaft between said fixed-position elements; and motion control means arranged to force repetitive, lateral push-pull sliding motion of said shaft, such that when said rotating hair plucking means is placed near the skin, sliding motion of said shaft therewithin causes said spaces to alternately open and tightly close, trapping skin hair in said spaces when opened and plucking it when closed.

2. The device of claim 1 wherein said fixed-position elements are interconnected with one another at least at one non-central point of said hair plucking means, a central portion of each of said movable elements being retained on said shaft, to move laterally therewith during said sliding motion.

3. The device of claim 1 wherein said fixed-position elements have outer edges formed with a flared shape, and wherein said shaft sliding motion causes each of said movable elements to arch slightly against an opposite one of said fixed-position elements, to insure tight contact therebetween.

4. The device of claim 1 further comprising an external support means arranged for rotation within said housing proximate said multiple-tweezer hair pluking means on a near side thereof, outer circumferential edges of said movable elements being fixed in a lateral position by said external support means on said near side, and being free to move laterally on a far side of said hair plucking means, while being free to rotate, said shaft sliding motion to close said spaces being reduced to about one-half the width thereof, allowing said alternate opening and closing of said spaces with an increased frequency during each hair plucking means rotation, and insuring closing of said outer circumferential edges on said far side against said fixed-position elements at a point of contact with concentrated force.

5. The device of claim 1 wherein said fixed-position and movable planar elements are each disc-shaped, enabling closing of said spaces therebetween at any time such that either side of each of said movable elements closes against an adjacent one of said fixed-position elements for plucking hair during said hair plucking means rotation.

6. The device of claim 1 wherein said hair plucking means is coupled for rotation by a first pair of gears mounted on a drive shaft rotationally powered by said motor, each of said first pair of gears being enmeshed with a respective one of a second pair of gears, a first one of said second pair of gears being mounted on said central shaft and a second one thereof being formed with said hair plucking means, such that substantially no torsinal forces are generated between said central shaft and said hair plucking means.

7. The device of claim 1 wherein said hair plucking means comprises a slitted drum structure having a hollow profile formed as a plurality of interconnected ridges, a plurality of slits being formed in each of said ridges at longitudinally spaced apart intervals therein, each slit defining a pair of opposite edges comprising said fixed-position elements, said movable elements being provided as a plurality of planar elements extending between said opposite edges of said slits, each movable element closing against said opposite edges.

8. The device of claim 1 wherein said motion control means comprises at least one cam follower affixed to an interior wall of said housing, said cam follower engaging a portion of a grooved cam mounted on said shaft, and causing said lateral push-pull sliding motion of said shaft during rotation.

9. A method of removing unwanted skin hair comprising the steps of:

providing a multiple-tweezer hair plucking means coupled to a means of rotational power, said hair plucking means comprising of set of interleaved fixed-position and movable planar elements defining spaces therebetween and being arranged for rotation with a central shaft which is slidable therethrough laterally in either direction, said movable elements being movable laterally with said shaft between said fixed-position elements by a motion control means arranged to force repetitive, lateral push-pull sliding motion of said shaft; and rotating said hair plucking means while it is passed over the skin, sliding motion of said shaft therewithin causing said spaces to alternately open and tightly close, trapping skin hair in said spaces when opened and plucking it when closed.

10. The method of claim 9 wherein said fixed-position elements are interconnected with one another at least at one non-central point of said hair plucking means, a central portion of each of said movable elements being retained on said shaft, to move laterally therewith during said sliding motion.

11. The method of claim 9 wherein said shaft sliding motion causes each of said movable elements to arch slightly against an opposite one of said fixed-position elements.

12. The method of claim 9 wherein siad multiple-tweezer hair plucking means further comprises an external support means arranged for rotation proximate thereto on a near side thereof, such that during rotation of said hair plucking means, outer circumferential edges of said movable elements are fixed in a lateral position by said external support means on said near side, and are free to move laterally on a far side of said hair plucking means, while being free to rotate, said shaft sliding motion to close said spaces being reduced to about one-half the width thereof, allowing said alternate opening and closing of said spaces with an increased frequency during each hair plucking means rotation, and insuring closing of said outer circumferential edges on said far side against said fixed-position elements at a point of contact with concentrated force.

13. The method of claim 9 wherein saif fixed-position and movable planar elements are each disc-shaped, enabling closing of said spaces between them at any time such that either side of each of said movable elements closes against an adjacent one of said fixed-position elements for plucking hair during said hair plucking means rotation.

14. The method of claim 9 wherein said hair plucking means is coupled for rotation such that substantially no torsional forces are generated between said central shaft and said hair plucking means.

* * * * *

UNITED STATES PATENT AND TRADEMARK OFFICE

CERTIFICATE OF CORRECTION

PATENT NO. : 5,112,341

DATED : May 12, 1992

INVENTOR(S) : Moshe DOLEV

It is certified that error appears in the above-identified patent and that said Letters Patent is hereby corrected as shown below:

On the title page:

The inventor's last name is "DOLEV", not "DOLEY", as printed

Item 76: correct spelling of inventor's last name is "DOLEV"

Item 19: correct spelling of inventor's last name is "DOLEV"

Signed and Sealed this

Second Day of March, 1993

*Attest:*

STEPHEN G. KUNIN

*Attesting Officer*

*Acting Commissioner of Patents and Trademarks*